United States Patent [19]

Bialkowski et al.

[11] Patent Number: 4,746,777

[45] Date of Patent: May 24, 1988

[54] VACUUM SWITCHING TUBE

[75] Inventors: Guenther Bialkowski; Burkhard Mick; Klaus Oberndorfer, all of Berlin, Fed. Rep. of Germany

[73] Assignee: Siemens Aktiengesellschaft, Berlin and Munich, Fed. Rep. of Germany

[21] Appl. No.: 23,827

[22] Filed: Mar. 9, 1987

[30] Foreign Application Priority Data

Jul. 11, 1986 [DE] Fed. Rep. of Germany ..... 3623457

[51] Int. Cl.[4] ..... H01H 33/66

[52] U.S. Cl. ..... 200/144 B

[58] Field of Search ..... 200/144 B

[56] References Cited

U.S. PATENT DOCUMENTS 3,590,197 6/1971 Wesoloski ..... 200/144 B
3,612,795 10/1971 Emmerich ..... 200/144 B
4,551,596 11/1985 Watanabe et al. ..... 200/144 B
4,614,850 9/1986 Kuhl et al. ..... 200/144 B
4,661,666 4/1987 Sakuma et al. ..... 200/144 B

*Primary Examiner*—Robert S. Macon
*Attorney, Agent, or Firm*—Hill, Van Santen, Steadman & Simpson

[57] ABSTRACT

A vacuum switching tube comprises a simply-constructed housing which is established in that cap-like metal portions are soldered blunt to the end faces of a ceramic portion, in that the metal parts comprise a cylindrical region of reduced wall thickness in the region of the ceramic parts, in that a step is formed in the inner wall at the transition to the thick-wall region to the thin-wall region, in that a vapor shield comprises an expanded edge region, and in that the edge region lies against the thin-wall cylindrical region and against the step and is soldered thereto. The tube is suitable for vacuum switching tubes in which the temperature coefficient of the metal portions is not matched to the temperature coefficient of the ceramic portion.

6 Claims, 1 Drawing Sheet

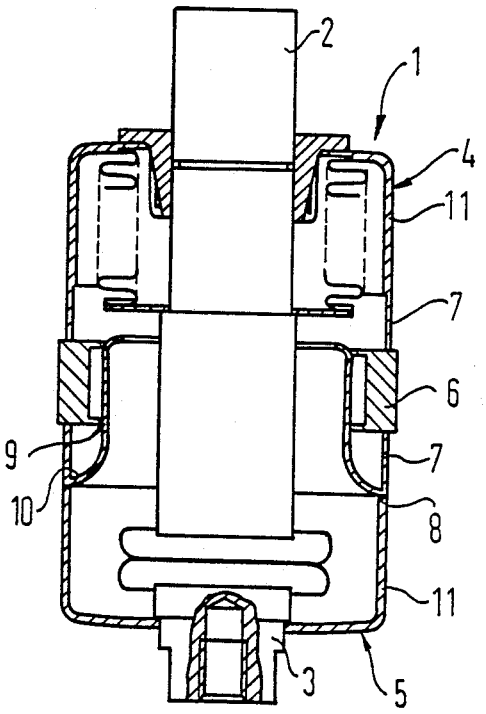
2
1
4
11
7
6
9
7
10
8
11
3
5

VACUUM SWITCHING TUBE

BACKGROUND OF THE INVENTION

The present invention relates to a vacuum switching tube comprising a housing which is composed of at least one ceramic portion and of metal portions, whereby at least one metal portion contains a thick-walled and a thin-walled cylindrical region, whereby a step preceding out in the radial direction is formed in the inner wall at the transition of the thick-walled to the thin-walled cylindrical region, whereby the thin-walled cylindrical region is connected to the end face of a ceramic element, and whereby a vapor screen is provided, and whereby the vapor screen is soldered to the step of the metal portion. Such a vacuum switching tube of the type generally set forth above is disclosed in U.S. Pat. No. 3,766,345, fully incorporated herein by this reference. The vacuum switching tube disclosed therein is constructed in a relatively complicated manner; it contains a plurality of solder locations and other metal-to-ceramic junctions. The shield design alone requires a plurality of retaining arms which must be soldered, first of all, to the shield and, secondly, to the thick-wall metal portion.

SUMMARY OF THE INVENTION

In comparison thereto, the object of the present invention is to provide, in this simplified manner, a simple structure and a simplification of the manufacturing method for the structure.

This object is achieved, in a device of the type set forth above, which is particularly characterized in that at least one metal portion is fashioned as a cap-like structure and is soldered blunt to the end face of the ceramic portion, in that the vapor screen comprises an edge region expanded in the radial direction, and in that the expanded edge region is matched to the diameter of the thin-wall cylindrical region, lies against the step, and is soldered at that location.

The metal portions are thereby advantageously composed of a material whose temperature coefficient is not matched to the temperature coefficient of the ceramic portion. For example, the metal portions can be composed of copper or of a stainless steel and the ceramic portion can be composed of aluminum oxide ceramic.

Assembly advantageously occurs in a method in which the metal portions, the ceramic portion and the shield or screen are soldered to one another in a single work step. Particularly small tolerances can be observed in that the shield and the metal portions are composed of the same material. Only one shield is thereby advantageously provided, this covering the entire ceramic portion in the axial direction.

The structure can easily be assembled and without special requirements made of an assembly form and can be soldered in a soldering process. The shield can thereby be held in a position illustrated on the drawing by the force of gravity until the soldering has been carried out.

BRIEF DESCRIPTION OF THE DRAWINGS

Other objects, features and advantages of the invention, its organization, construction and operation will be best understood from the following detailed description, taken in conjunction with the accompanying drawing, on which:

FIG. 1 is a sectional view taken through a vacuum switching tube constructed in accordance with the present invention.

DESCRIPTION OF THE PREFERRED EMBODIMENT

A switching tube comprises a housing 1 and switch contacts 2 and 3 arranged coaxially relative to one another. The housing 1 comprises metal caps 4 and 5 and a ceramic ring 6. The metal caps 4 and 5 comprise thin-walled cylindrical regions 7, whereby at least one metal portion 5 comprises a step 8 at its inner wall at the transition from the thick-walled portion 11 to the thin-walled cylindrical section 7, the step 8 extending outwardly in the radial direction.

A vapor shield 9 comprises an edge region 10 which expands toward the exterior of the device. The edge region 10 lies against the thin-walled cylindrical region 7 and against the step 8 of the cap 5 and is hard-soldered to the cap 5.

The thin-walled cylindrical regions 7 are soldered blunt to the ceramic ring 6 and their wall thickness is dimensioned such that the warping occurring during soldering and due to the different thermal expansion between the ceramic ring 6 and the thin-walled cylindrical region 7 is intercepted by the solder location and does not lead to an untightness of the tube.

The shield 9 covers the ceramic portion 6 in the axial direction, so that one shield 9 suffices for vapor shielding. As a result thereof, the shield 9 can be inserted, during manufacture, and can be applied to the step 8 and remains there merely as a consequence of the force of gravity when the tube is held in the position illustrated during soldering. The other portions can also be held stacked on top of one another for soldering without involved holding devices and can be soldered in one work step.

In this embodiment, the single-solder arrangement of the contacts in the region of the lower metal cap 5 is advantageous, since a relatively large switching space is available here and the metal vapor which occurs can be kept away from the ceramic portion 6 in a particularly suitable manner.

Although I have described my invention by reference to particular illustrative embodiments thereof many changes and modifications of the invention may become apparent to those skilled in the art without departing from the spirit and scope of the invention. I therefore intend to include within the patent warranted herein all such changes and modifications as may reasonably and properly be included within the scope of my contribution to the art.

I claim:

1. A vacuum switching tube comprising:

a ring-shaped ceramic part including a pair of annular faces;

a pair of cap-shaped metal parts each including a thick-walled portion, and at a transition thereto, a thin-walled portion connected blunt to respective faces of said ceramic ring;

a pair of contacts each extending through a respective thick-walled portion to a location adjacent the other such contact; and a generally bell-shaped vapor shield surrounding one of said contacts and including a cylindrical portion comprising an edge matched to the dimensions of said thin-walled portions and connected to one of said cap-shaped metal parts at the respective transition.

2. The vacuum switching tube of claim 1, wherein: each of said transitions is in the form of a step.

3. The vacuum switching tube of claim 1, wherein: each of said cap-shaped metal parts comprises a material having a first temperature coefficient; and said ceramic part comprises a material having a second temperature coefficient.

4. The vacuum switching tube of claim 1, wherein: said cap-shaped metal parts and said vapor shield comprise the same material.

5. The vacuum switching tube of claim 1, wherein: said vapor shield extends axially from the one metal part to the other metal part and past said ring-shaped ceramic part.

6. A method of making a vacuum switching tube, comprising the steps of:

mounting respective contacts in downwardly-open and upwardly-open metal cap-shaped parts;

placing a vapor shield around the contact of the downwardly-open part;

placing the downwardly open metal part above the upwardly-open metal part and between these metal parts a ring-shaped ceramic part;

positioning the upwardly-open and downwardly-open metal parts against the opposite faces of the ring-shaped ceramic part for building a blunt annection; and soldering the ring-shaped ceramic part, the vapor shield and the upwardly-open and downwardly-open metal parts together in one soldering step.

* * * * *